US006646393B1

(12) United States Patent
LaPeruta, Jr. et al.

(10) Patent No.: US 6,646,393 B1
(45) Date of Patent: Nov. 11, 2003

(54) METHOD OF OPERATING A POSITIVE TOLERANCE CRT

(75) Inventors: Richard LaPeruta, Jr., Lititz, PA (US); George Milton Ehemann, Jr., Lancaster, PA (US); Brian Thomas Collins, Lititz, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 0 days.

(21) Appl. No.: 10/185,156

(22) Filed: Jun. 27, 2002

(51) Int. Cl.[7] ..... G09G 29/70
(52) U.S. Cl. ..... 315/395; 313/407; 313/414
(58) Field of Search ..... 315/369, 382, 315/395; 313/407, 473, 477, 482, 398, 460, 414

(56) References Cited

U.S. PATENT DOCUMENTS 4,099,088 A * 7/1978 Hart ..... 313/450
4,243,908 A * 1/1981 Brenner, Jr. ..... 313/407
4,369,396 A * 1/1983 Judd ..... 315/369
5,066,887 A * 11/1991 New ..... 313/414

* cited by examiner

*Primary Examiner*—Don Wong
*Assistant Examiner*—Jimmy T. Vu
(74) *Attorney, Agent, or Firm*—Joseph S. Tripoli; Carlos M. Herrera; Patricia A. Verlangieri

(57) ABSTRACT

A method of operating a positive tolerance color cathode-ray tube (CRT) having an evacuated envelope with an electron gun and a focus mask therein for generating at least one electron beam. The envelope further includes a faceplate panel having a luminescent screen of color-emitting phosphor stripes on an interior surface thereof. The color-emitting phosphor stripes each have a width slightly smaller than one-third of the screen pitch, such that large clipping and leaving tolerances may be achieved therewith. The focus mask, having a plurality of spaced-apart first conductive electrodes, is located adjacent to an effective picture area of the screen. The spacing between the first conductive electrodes defines a plurality of slots substantially parallel to the color-emitting phosphor stripes on the screen. Each of the first conductive electrodes has a substantially continuous insulating material layer formed on a screen facing side thereof. A plurality of second conductive electrodes (wires) are oriented substantially perpendicular to the plurality of first conductive electrodes and are bonded thereto by the insulating material layer. The method includes directing electron beams toward the color-emitting phosphors on the screen and applying an appropriate differential voltage to the two sets of conductive electrodes to achieve desired clipping and leaving tolerances of the CRT tube.

6 Claims, 5 Drawing Sheets

METHOD OF OPERATING A POSITIVE TOLERANCE CRT

BACKGROUND OF THE INVENTION

1. Field of the Invention

This invention relates to a color cathode-ray tube (CRT) and, more particularly to a color CRT including a tension focus mask.

2. Description of the Background Art

A color cathode-ray tube (CRT) typically includes an electron gun, an aperture mask, and a screen. The aperture mask is interposed between the electron gun and the screen. The screen is located on an inner surface of a faceplate of the CRT tube. The screen has an array of three different color-emitting phosphors (e.g., green, blue, and red) formed thereon. The aperture mask functions to direct electron beams generated in the electron gun toward appropriate color-emitting phosphors on the screen of the CRT tube.

The aperture mask may be a focus mask. Focus masks typically comprise two sets of conductive electrodes (or wires) that are arranged approximately orthogonal to each other, to form an array of openings. Different voltages are applied to the two sets of conductive electrodes so as to create quadrupole focusing lenses in each opening of the mask. The quadrupole focusing lenses are used to direct the electron beams toward the color-emitting phosphors on the screen of the CRT tube.

The electron beams that are directed onto the color-emitting phosphors through the aperture mask may have either a positive tolerance or a negative tolerance. An incident electron beam whose cross-section is larger than the area of its corresponding effective color-emitting phosphor element is characterized as being a negative tolerance system. A negative tolerance tube typically has opaque matrix lines separating the phosphor elements, wherein the phosphor elements are located in matrix openings located between the matrix lines. An incident electron beam whose cross-section is smaller than the area of its corresponding effective color-emitting phosphor element is characterized as a being a positive tolerance system. In a positive tolerance system the beam cross-section essentially defines the width of the effective phosphor element. The term effective phosphor element as used in this disclosure refers to the stripe width of the phosphor stripe that a viewer can observe. In conventional negative tolerance tubes, the width of the phosphor element equals the width of the matrix opening.

Additionally, the electron beams that are directed onto the color-emitting phosphors through the aperture mask may also have clipping tolerances as well as leaving tolerances. The term clipping tolerance refers to the smallest distance that the electron beam can move relative to the screen before the electrons in the incident electron beam start to excite an adjacent (incorrect) color-emitting phosphor element. For negative tolerance CRTs, leaving tolerance refers to the smallest distance that the edge of an electron beam can move relative to the screen before part of a phosphor element is no longer excited by electrons in the incident electron beam. In positive tolerance CRTs, leaving tolerance refers to the smallest distance an edge of the beam must move to begin missing part of the effective phosphor element.

Conventional negative tolerance aperture mask CRT's typically have clipping and leaving tolerances that are built into each tube and may be only slightly adjusted. For example, for a CRT having a 0.68 mm screen pitch, the magnitude of adjustment for either of the clipping or leaving tolerances is typically less than about 0.025 mm (1 mil). Also, generally adjustments to either of the clipping and leaving tolerances, inversely affect the other. For example, increasing the leaving tolerance of a CRT will decrease the clipping tolerance thereof, and vice versa. This inverse relationship is true unless the phosphor elements are made smaller. In such case, the clipping and leaving tolerances can both be increased; however, this done at the expense of light output.

Thus, a need exists for cathode-ray tubes (CRT) with large clipping and leaving tolerances without sacrificing light output.

SUMMARY OF THE INVENTION

The present invention relates to a method of operating a cathode-ray tube (CRT) having a focus mask in a positive tolerance mode, wherein the CRT has an evacuated envelope with an electron gun therein for generating at least one electron beam. In the preferred embodiment, the envelope further includes a faceplate panel having a luminescent screen with only color-emitting phosphor stripes on an interior surface thereof. The color-emitting phosphor stripes each have a width slightly smaller than one-third of the screen pitch, such that large clipping and leaving tolerances may be achieved therewith. The focus mask has a plurality of spaced-apart first conductive electrodes and is located adjacent to an effective picture area of the screen. The spacing between the first conductive electrodes defines a plurality of slots substantially parallel to the color-emitting phosphor stripes on the screen. Each of the first conductive electrodes has a substantially continuous insulating material layer formed on a screen facing side thereof. A plurality of second conductive electrodes (wires) are oriented substantially perpendicular to the plurality of first conductive electrodes and are bonded thereto by the insulating material layer. The method comprises directing electron beams from electron guns in the envelop toward the color-emitting phosphors on the screen and selectively applying different voltages to the two sets of conductive electrodes such that clipping and leaving tolerances of the CRT are selectively increased.

BRIEF DESCRIPTION OF THE DRAWINGS

The invention will now be described in greater detail, with relation to the accompanying drawings, in which.

DETAILED DESCRIPTION OF THE INVENTION

Figure 1:
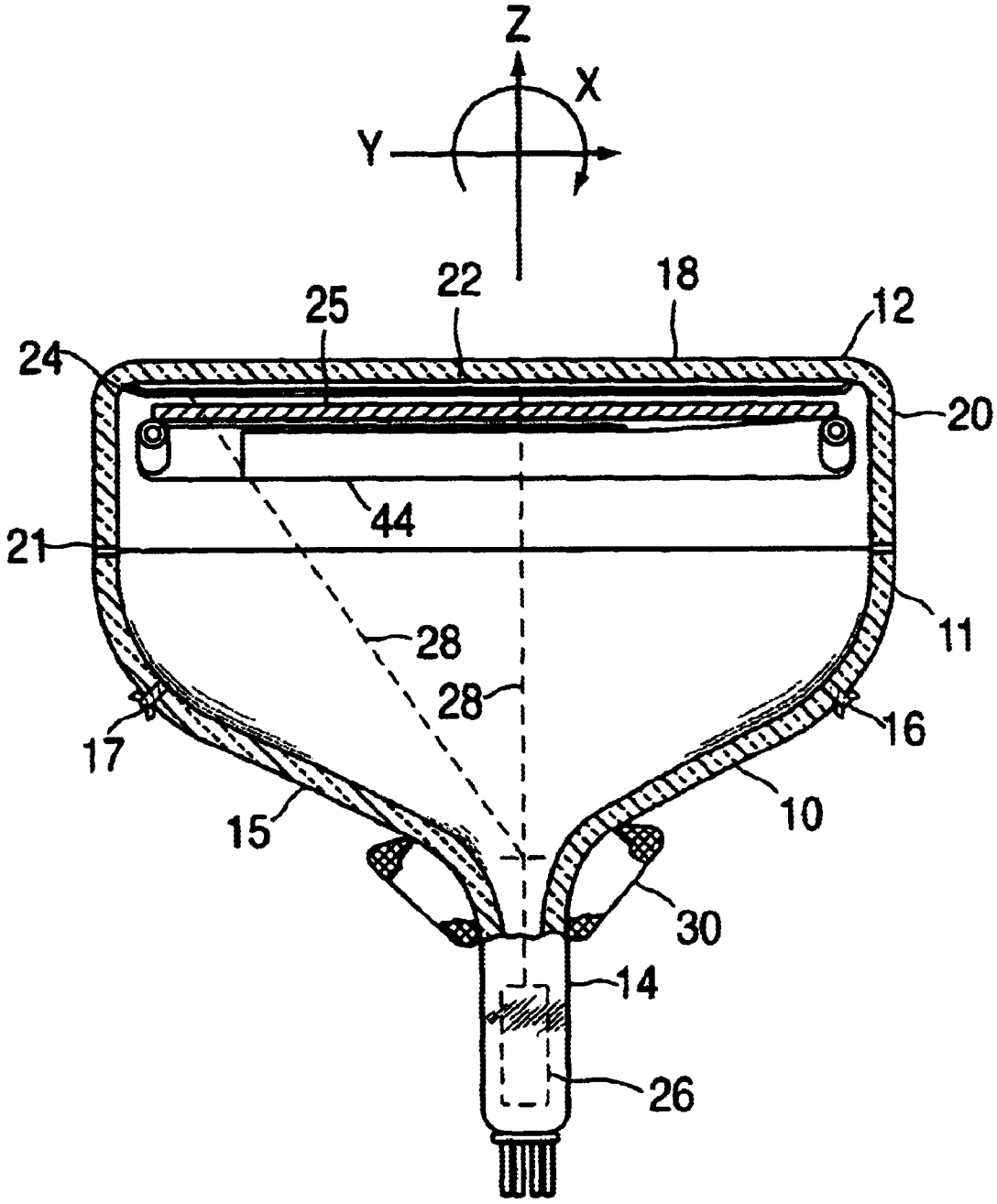
FIG. 1 is a plan view, partly in axial section, of a color cathode-ray tube (CRT) embodying the present invention.
Figure 2:
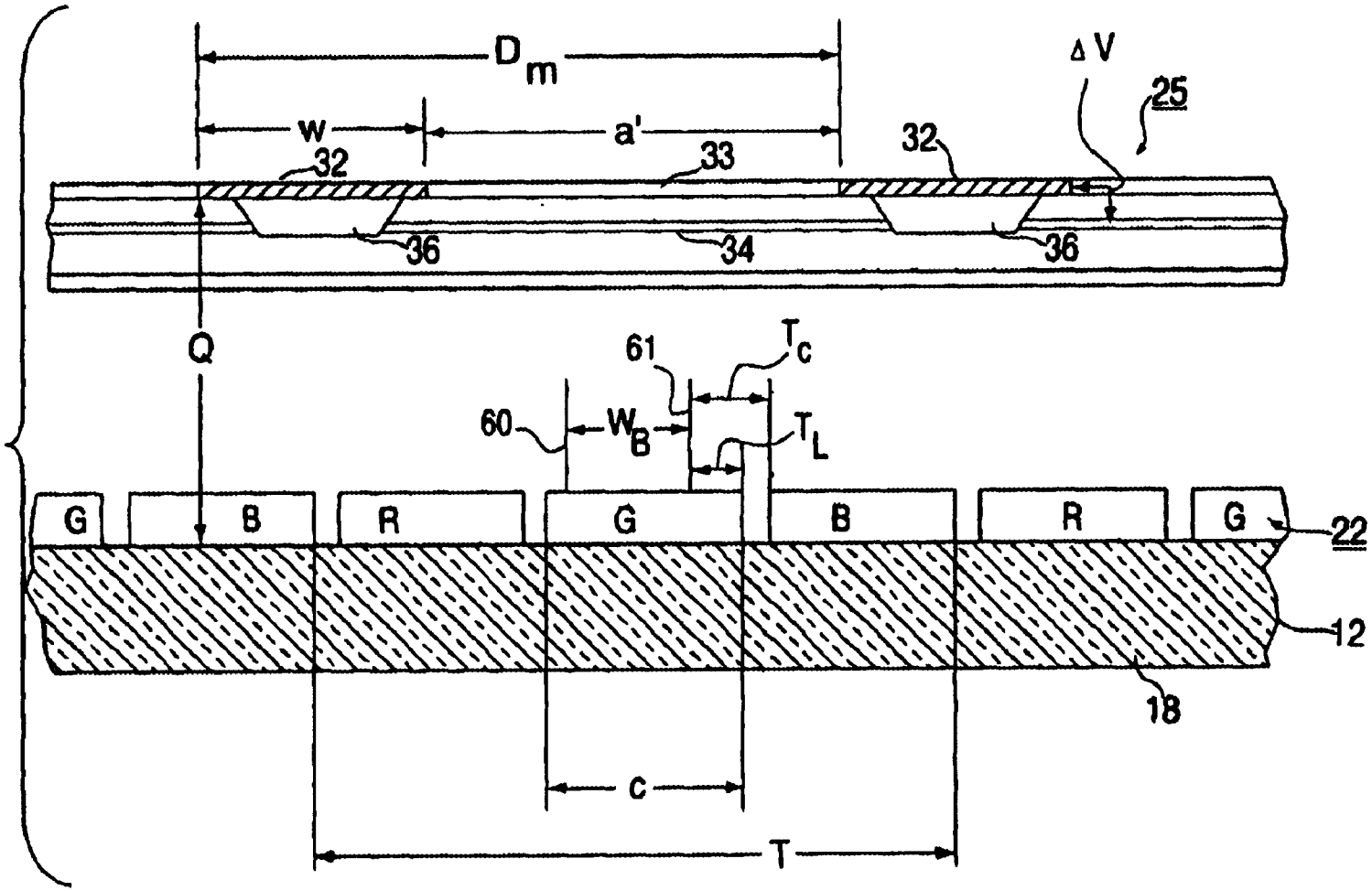
FIG. 2 is a section of a tension focus mask and a faceplate portion of the CRT of FIG. 1, showing a screen assembly.

FIG. 1 shows a color cathode-ray tube (CRT) 10 having a glass envelope 11 comprising a faceplate panel 12 and a tubular neck 14 connected by a funnel 15. The funnel has an internal conductive coating (not shown) that is in contact with, and extends from, an anode button 16 to the neck 14. The faceplate panel 12 comprises a viewing faceplate 18 and a peripheral flange or sidewall 20 that is sealed to the funnel 15 by a glass frit 21. A three-color luminescent phosphor screen 22 is carried on the inner surface of the viewing faceplate 18. The screen 22, shown in cross-section in FIG. 2, is a line screen which includes a multiplicity of screen elements comprising red-emitting, green-emitting, and blue-emitting phosphor stripe R, G, and B, respectively, arranged in triads, each triad including a phosphor stripe of each of the three colors. The R, G, B, phosphor stripes are generally printed with a vertical orientation. The phosphor stripes have a width, C. In the embodiment of the invention shown in FIG. 2, no matrix lines are present and the phosphor stripes are printed such that a small gap exists in between the phosphor stripes. In the completed CRT, a thin conductive layer 24, preferably of aluminum, overlies the screen 22. A tension focus mask 25 is removably mounted by conventional means within the faceplate panel 12 in predetermined spaced relation to the screen 22. This distance, Q, is referred to as the "Q" spacing. The CRT also includes an electron gun 26, shown schematically by the dashed lines in FIG. 1, which is centrally mounted within the neck 14, to generate and direct three inline electron beams 28, a center and two side or outer beams, along convergent paths through the tension focus mask 25 to the screen 22. The inline direction of the center beam 28 is approximately normal to the plane of the paper.

The CRT 10 of FIG. 1 is designed to be used with an external magnetic deflection yoke 30, in the neighborhood of the funnel-to-neck junction. When activated, the yoke 30 subjects the three electron beams 28 to magnetic fields that cause the electron beams 28 to scan a horizontal and vertical rectangular raster across the screen 22.

Figure 3:
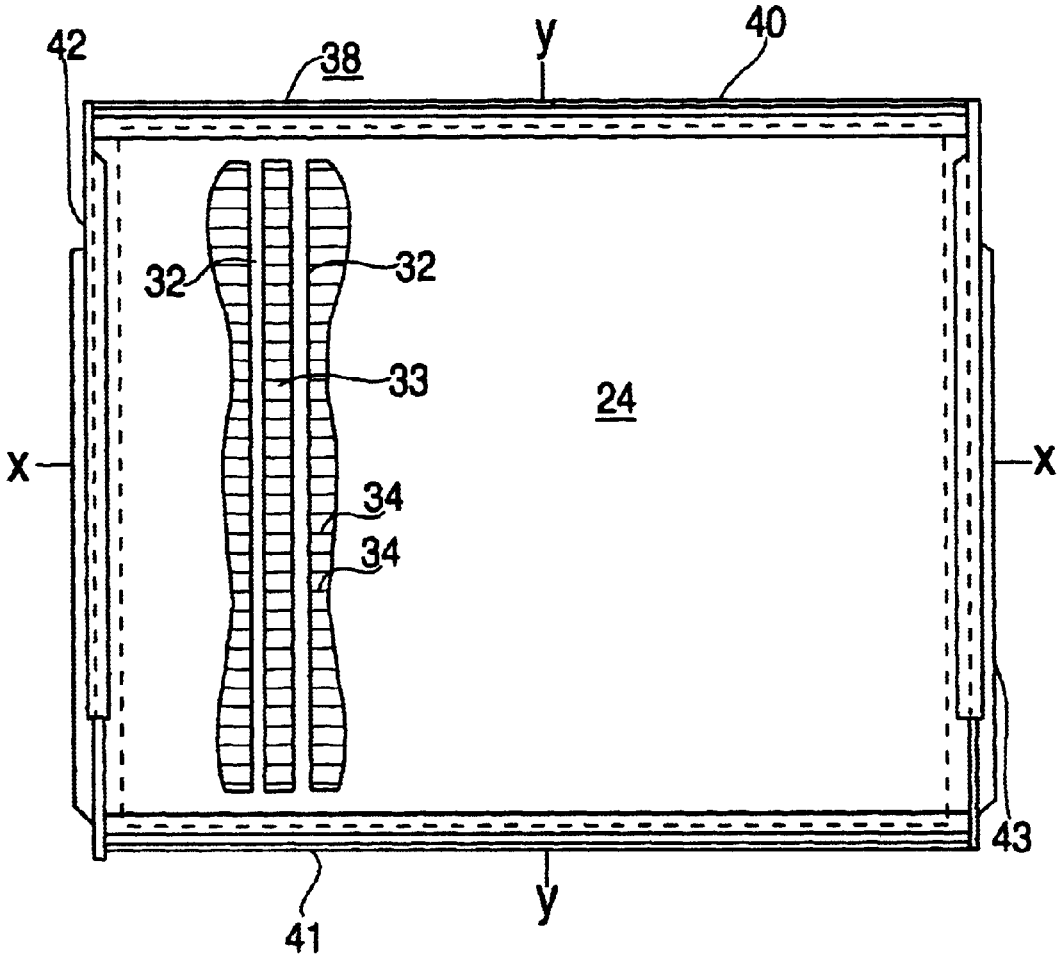
FIG. 3 is a plan view of a tension focus mask and frame used in the CRT of FIG. 1.

As shown in FIG. 3, the tension focus mask 25 is formed, preferably, from a thin rectangular sheet of about 0.05 mm (2 mil) thick low carbon steel, that includes two horizontal sides and two vertical sides. The two horizontal sides of the mask 25 parallel the central major axis, X, of the mask and the two vertical sides parallel the central minor axis, Y, of the mask. With reference to FIGS. 2 and 3, the tension focus mask 25 includes an apertured portion that contains a plurality of elongated strands 32 separated by slots 33 that parallel the minor axis, Y, of the mask.

In one configuration, the mask pitch, $D_m$, defined as the transverse dimension of a strand 32 and an adjacent slot 33, is 0.87 mm (35 mils). As shown in FIG. 2, each strand 32 can have a transverse dimension, or width, w, of about 0.38 mm (15 mils) and each slot 33 can have a mask opening width, a', of about 0.53 mm (21 mils). The slots 33 extend from one horizontal side of the tension focus mask 25 to the other horizontal side thereof. A plurality of cross-wires 34, each having a diameter of about 0.025 mm (1 mil), are disposed substantially perpendicular to the strands 32 and are spaced therefrom by insulators 36. In operation, a voltage differential, ΔV, exists between the cross-wires 34 and strands 32.

Again with reference to FIG. 2, the screen 22, formed on the viewing faceplate 18, includes three different color-emitting phosphor stripes located adjacent to one another. The color-emitting phosphor lines each have a width, c, slightly less than one-third of the screen pitch, T. In a preferred embodiment of the invention, the screen structure includes adjacent phosphor stripes that nearly touch each other without overlapping and with no matrix lines printed on the screen 22. During CRT operation, the electron beams 28 pass through the slots 33 (mask apertures) of the tension focus mask 25 and are focused on their respective phosphor stripes. In the preferred embodiment, the incident beam has a lateral dimension, $W_B$, that is just smaller than a footprint width wherein beam clipping or leaving may occur. The ability to adjust the beam footprint provides a means for selecting the clipping tolerance such that large clipping and leaving tolerances may be achieved therewith. FIG. 2 shows the clipping tolerance, $T_C$, and the leaving tolerance, $T_L$, of the beam having a beam lateral dimension, $W_B$.

Figure 5A:
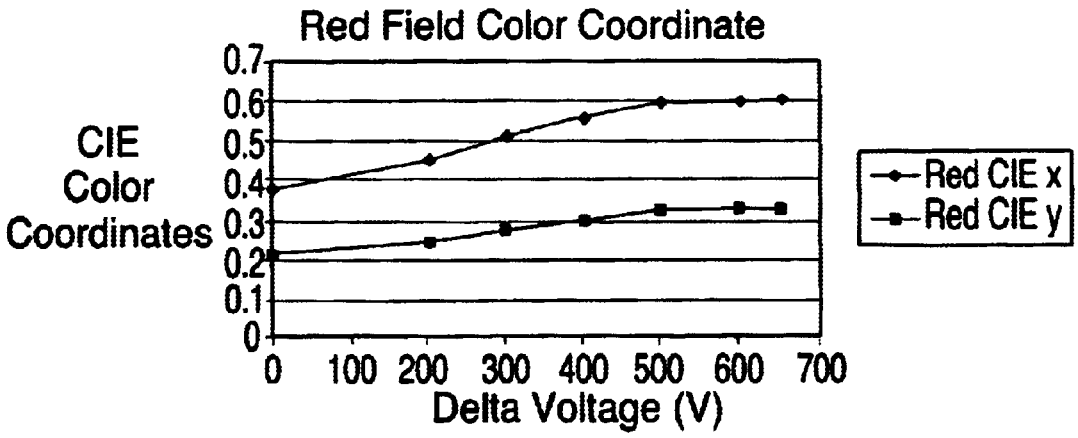
FIGS. 5*a*–5*c* are graphs depicting each of the three color coordinates for the red, green, and blue phosphor stripes plotted as a function of the voltage differential between the two sets of electrodes on the tension focus mask.
Figure 5B:
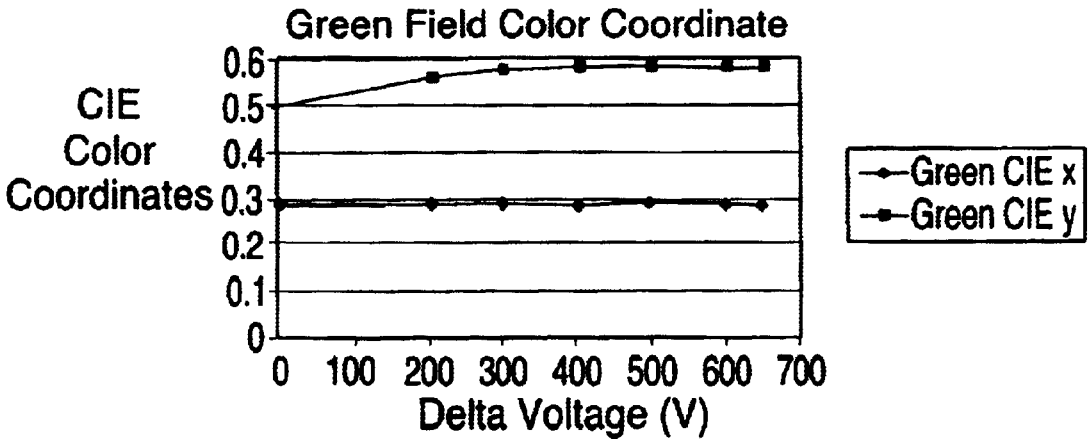
Figure 5C:
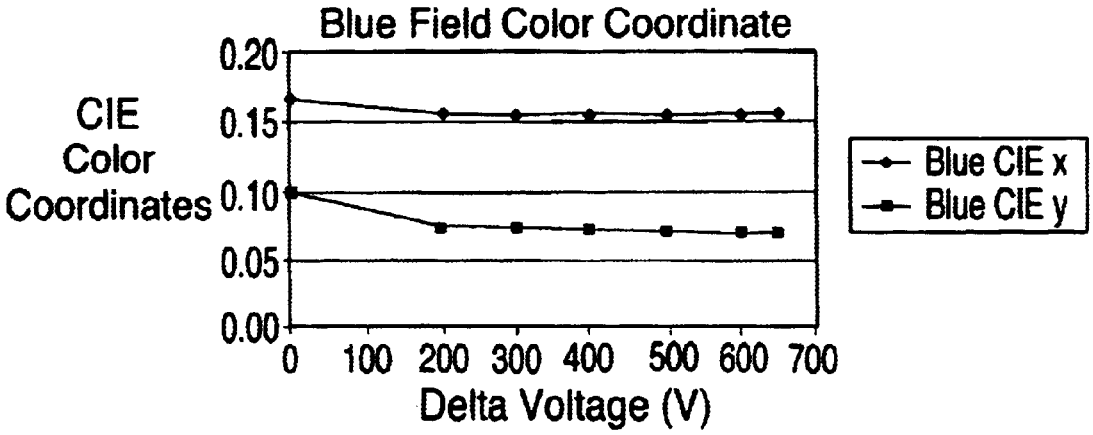

In one example for a CRT having 68 cm diagonal and a screen pitch, T, of about 0.96 mm (38 mils), each phosphor stripe will preferably have a width, C, just below 0.32 mm (12.7 mils) such as 0.30 mm (11.9 mils). For this embodiment, the tension focus mask 25 can have Q-space, Q, of about 15.24 mm (600 mils) from the center of the interior surface of the faceplate panel 12, wherein the voltage differential, ΔV, can be from 300 V to 700 V. The method according to the invention includes having the operator dial in a voltage differential, ΔV, large enough to prevent clipping or leaving of the electron beam. One suggested means of selecting the voltage differential, ΔV, involves looking at the color coordinate values for the respective phosphor colors as the individual beams operate as a function of the voltage differential, ΔV. FIGS. 5(*a*)–5(*c*) show such data wherein inspection of the individual curves suggests that the most suitable voltage differential, ΔV, is about 500 V. The reason is that at 500 V all of the curves level out indicating that the individual electron beams are incident on their intended phosphor stripe with no occurrence of clipping. Operating the voltage differential, ΔV, above 500 V, for this particular CRT, is not necessary and, in fact, the voltage differential should be set no higher than this value because the propensity for electrical failure of the insulator does increase with increasing voltage differential. As such, the method according to this invention provides the manufacturer not only the means to insure that the clipping and leaving do not occur, but also provides a means of insuring that the voltage differentials are selected for each tube which are no higher than necessary, thereby providing some level protection and quality assurance for the CRT.

In any CRT, the contrast, which in general terms is light output signal to ambient noise, is always a consideration. In CRTs having black matrix, the matrix helps to improve the contrast because a significant portion of ambient light propagating into the panel will be absorbed by the matrix, thereby preventing such ambient light from going back to the viewer. In cases where no matrix is present, the contrast typically suffers. However, in the preferred embodiment of this invention, the mere fact that the light output of the CRT is significantly larger than that of comparable conventional CRTs significantly improves the contrast. Furthermore, as in conventional CRTs, the manufacturer can improve the contrast by implementing faceplate panels 12 having lower transmission characteristics or use antiglare coatings on the panels 12.

Figure 4:
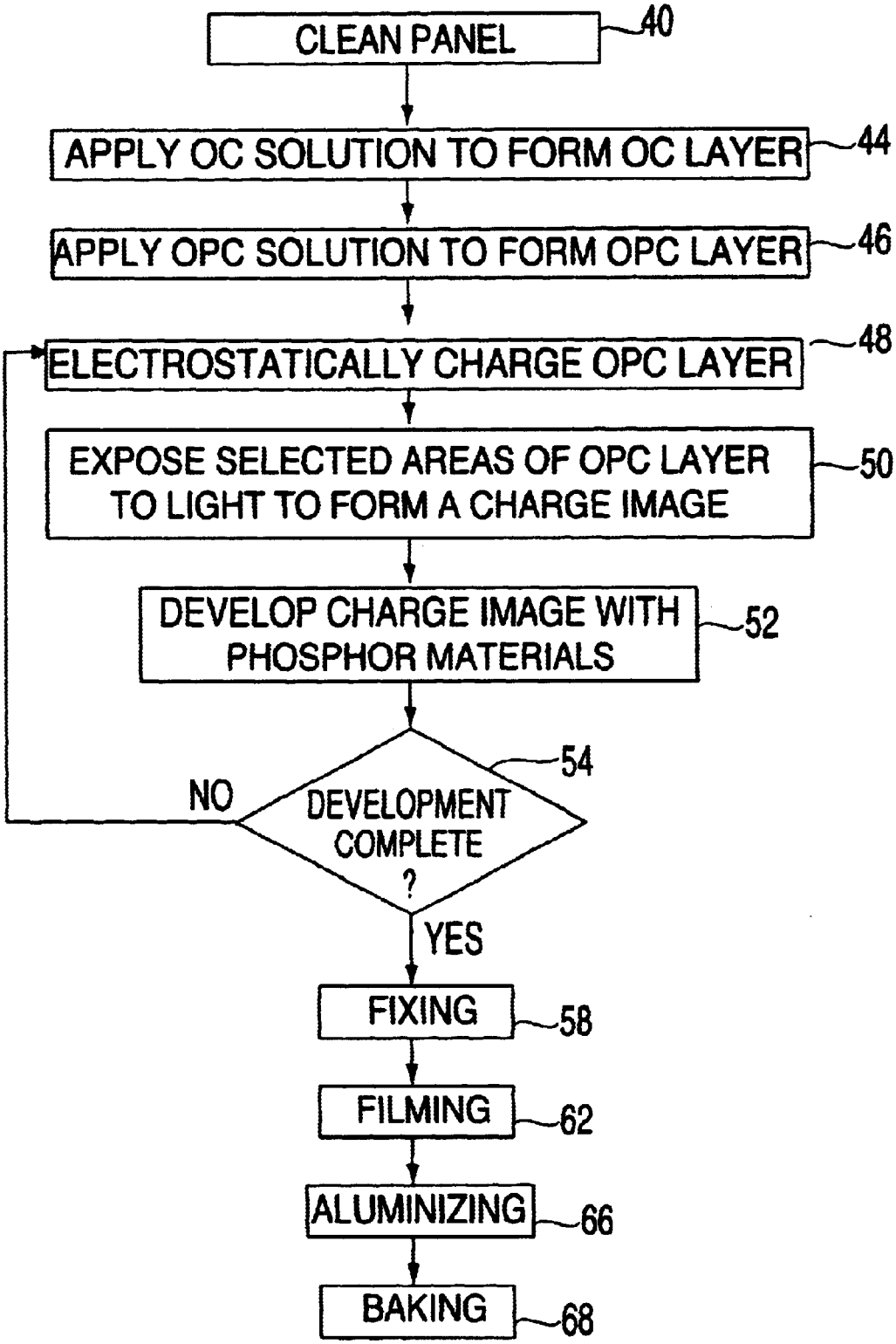
FIG. 4 is a block diagram comprising a flow chart of the manufacturing process for the faceplate of FIG. 2.

The screen 22 of the CRT in this invention can be manufactured using an electrophotographic screening (EPS) process that is shown schematically in FIG. 4. Suitable EPS processes are described in U.S. Pat. No. 5,370,952 issued to Datta et al. on Dec. 6, 1994 and U.S. Pat. No. 5,554,468 issued to Datta et al. on Sep. 10, 1996. The OC layer in step 44 of FIG. 4 refers to a suitable layer of a volatilizable, organic conductive (OC) material on the interior surface of the viewing faceplate 18. The OPC layer in step 46 refers to the organic photoconductive (OPC) layer over the OC layer. The OPC layer is then electrostatically charged, as indicated in step 48 of FIG. 4, using a corona discharge device.

Thereafter, selected areas of the OPC layer are discharged with light in step 50 in FIG. 4 with the mask 25 inserted into the faceplate panel 12. The light source positions are chosen to selectively create charge images on the OPC which determine where the selected charged phosphor particles shall be deposited on the panel 12 in step 52. Step 52 is done with the mask not in the panel 12. After the first color phosphor is deposited, steps 48–52 are repeated for each of the other phosphor colors. The EPS process can either be performed by way of "reversal" development, meaning the deposition of charged phosphor particles having the same charge polarity as that of the charged OPC layer such that the phosphor will land on the exposed, discharged regions on the OPC. The EPS process can likewise be performed by "attractive" development where the phosphor has the opposite charge as that of the OPC and as such the phosphor will deposit on the unexposed regions. The three light-emitting phosphors are fixed in step 58 of FIG. 4 by contacting the phosphors with a suitable fixative composition. The screen is then filmed in step 62, aluminized in step 66, and baked in step 68 prior to the finishing processes.

The EPS screening process is the preferred means of depositing the phosphor for this the claimed invention because such a process is an effective means of printing phosphor stripes for CRTs having mask aperture widths that exceed 20% of the mask pitch. The width of each of the lines, C, of the three different color-emitting phosphors should preferably be slightly less than one-third of the screen pitch, T. Such an arrangement advantageously increases screen brightness by providing larger areas upon which the electron beams may impinge. Additionally, increasing the widths of each of the three color-emitting phosphors increases the magnitude of adjustment for both the clipping and leaving tolerances, thereby providing an opportunity for improving the color purity of the screen.

Since light absorbing matrix is not present on this screen 22, any perturbations in the mask 25 will advantageously not be readily apparent in the screen 22. Typical light absorbing matrix is black and substantially darker than the color of the phosphors. As such, mask blemishes that are printed in the matrix contrast dramatically with the phosphor body color, thereby becoming visible on the screen 22. In the preferred embodiment, without the matrix, mask blemishes may not be apparent due to the diminished contrast between the different phosphor body colors.

By utilizing the claimed invention, the CRT manufacturer can essentially optimize voltage differential for each individual tube. The result is that the manufacturer can effectively mitigate negative consequences associated with manufacturing variability. One such example is that of variability is Q-space. Typically, manufacturers often experience 5% variability in Q-space from tube-to-tube. With all other things being equal, two tubes having different Q-spaces will have different clipping tolerances and likely have different leaving tolerances. The use of the claimed invention gives the manufacturer an opportunity to make the clipping tolerances equal. Likewise, variability in phosphor register, phosphor stripe width, and ambient magnetic environment can be mitigated utilizing the claimed invention.

The scope of the invention also includes the feature of dynamically adjusting the voltage differential in the mask such that as the electron beam is scanned across the mask the voltage differential can be optimized for each specific mask location. One skilled in the art will recognize this as an important feature in light of the fact that the reality of tube manufacturing not only includes variability from tube-to-tube, but also includes variability in location-to-location within a given tube. Therefore, the result is that the manufacturer is not only afforded the ability to optimize the clipping and leaving tolerances from one tube to the next, but the manufacturer is afforded the opportunity to vary the voltage differential from location-to-location within a given tube to optimize the tolerances in a plurality of locations.

Additionally the scope of the invention includes luminescent screens 22 having matrix lines separating the phosphor stripes, wherein the voltage differential, $\Delta V$, is large enough to make the beam lateral dimension, $W_B$, smaller than the phosphor line width, C, and smaller than the respective matrix opening which contains the phosphor line. The scope of the invention also includes the scenarios where adjacent phosphor lines are in contact with one another and when phosphor lines actually overlap. In either case, the voltage differential, $\Delta V$, should be large enough to make the beam lateral dimension, $W_B$, smaller than the phosphor line width, C, to the extend that an electron beam only excites its intended phosphor.

What is claimed is:

1. A method of operating a cathode-ray tube (CRT) having an evacuated envelope having herein an electron gun for generating at least one electron beam, a faceplate panel having a luminescent screen with corresponding phosphor stripes on an interior surface thereof, wherein said CRT includes a focus mask, said focus mask having a plurality of spaced-apart first conductive electrodes and a plurality of spaced-apart second conductive electrodes oriented substantially perpendicular to the plurality of spaced-apart first conductive electrodes, said method including:

directing said at least one electron beam from said electron gun in said envelope toward said focus mask and through slots between adjacent said spaced-apart first conductive electrodes; and applying a voltage differential between said plurality of spaced-apart first conductive electrodes and said plurality of spaced-apart second conductive electrodes that is large enough to operate said CRT in a positive tolerance mode in at least one location, wherein a lateral dimension of said at least one electron beam incident at said interior surface is less than a lateral dimension of said corresponding phosphor stripes.

2. The method of claim 1, wherein said lateral dimension of said beam decreases as the voltage differential increases and clipping and leaving tolerances of said beam increase with increasing said voltage differential.

3. The method of claim 1, wherein each phosphor stripe has a lateral dimension approximating one-third of the luminescent screen pitch.

4. The method of claim 1, wherein each of said phosphor stripes is adjacent to one another without light-absorbing material therebetween.

5. The method of claim 2, wherein said voltage differential can vary from location to location across said mask, thereby permitting the opportunity to vary said clipping and leaving tolerances from location to location across said luminescent screen.

6. The method of claim 5, wherein said voltage differential is set in each location such that there is no clipping or leaving of any of said beams throughout said luminescent screen.

* * * * *